United States Patent [19]

Arakawa et al.

[11] Patent Number: 5,072,205

[45] Date of Patent: Dec. 10, 1991

[54] WOUND MAGNETIC CORE

[75] Inventors: Shunsuke Arakawa; Kiyotaka Yamauchi; Noriyoshi Hirao, all of Kumagaya, Japan

[73] Assignee: Hitachi Metals, Ltd., Tokyo, Japan

[21] Appl. No.: 473,476

[22] Filed: Feb. 1, 1990

[30] Foreign Application Priority Data

Feb. 2, 1989 [JP] Japan ..... 1-22606

[51] Int. Cl.[5] ..... H01F 27/24

[52] U.S. Cl. ..... 336/213; 338/219

[58] Field of Search ..... 336/213, 214

[56] References Cited

FOREIGN PATENT DOCUMENTS

| | | |
|---|---|---|
| 0271657 | 6/1988 | European Pat. Off. . |
| 63-110607 | 5/1988 | Japan . |
| 63-229786 | 9/1988 | Japan . |
| 63-302504 | 12/1988 | Japan . |
| 64-42230 | 2/1989 | Japan . |

*Primary Examiner*—John P. Sheehan

*Attorney, Agent, or Firm*—Finnegan, Henderson, Farabow, Garrett & Dunner

[57] ABSTRACT

A wound magnetic core constituted by (a) a thin ribbon made of a fine crystalline, soft magnetic Fe-base alloy having the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti and Mo, and a, x, y, z and $\alpha$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$ and $0.1 \leqq \alpha \leqq 30$, at least 50% of the alloy structure being occupied by fine crystal grains having an average grain size of 1000 Å or less; and (b) a heat-resistant insulating layer having a thickness of 0.5–5 μm formed on at least one surface of the thin ribbon, the heat-resistant insulating layer being made of a uniform mixture of 20–90 weight %, as $SiO_2$, of a silanol oligomer and 80–10 weight % of fine ceramic particles, which is subjected to a heat treatment to cross-link the silanol oligomer.

8 Claims, 1 Drawing Sheet

WOUND MAGNETIC CORE

BACKGROUND OF THE INVENTION

The present invention relates to wound magnetic core constituted by a thin ribbon of a fine crystalline, soft magnetic Fe-base alloy and a method of producing it, and more particularly to a wound magnetic core constituted by a thin ribbon of a fine crystalline, soft magnetic Fe-base alloy coated with a heat-resistant insulating layer, thereby showing excellent high-frequency magnetic properties, high-voltage magnetic properties, etc. and a method of producing it.

There have recently been developed as magnetic materials having excellent high-frequency properties, fine crystalline, soft magnetic Fe-base alloys having extremely fine crystalline structures having an average grain size of 1000 Å or less (EP0271657 and Japanese Patent Laid-Open No. 63-302504).

These fine crystalline, soft magnetic Fe-base alloys include a fine crystalline, soft magnetic Fe-base alloy having the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti and Mo, and a, x, y, z and $\alpha$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$ and $0.1 \leqq \alpha \leqq 30$, at least 50% of the alloy structure being occupied by fine crystal grains having an average grain size of 1000 Å or less; and a fine crystalline, soft magnetic Fe-base alloy having the composition represented by the general formula:

$$(Fe_{1-a}M_a)_{100-x-y-z-\alpha-\beta-\gamma}Cu_xSi_yB_z\cdot M'_\alpha M''_\beta X_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$, $\beta \leqq 10$ and $\gamma \leqq 10$, at least 50% of the alloy structure being occupied by fine crystal grains having an average grain size of 1000 Å or less.

These alloys can usually be obtained by preparing amorphous alloys and then subjecting them to a heat treatment at a temperature higher than their crystallization temperatures.

When thin ribbons of the above alloys are used to produce wound magnetic cores for saturable reactors, transformers, etc., they are preferably insulated by insulating tapes such as polyimide films, polyethylene terephthalate films or insulating layers of oxide powders such as $SiO_2$, MgO, $Al_2O_3$, etc. to decrease eddy current losses which are main causes of core losses of the wound magnetic cores (Japanese Patent Laid-Open No. 63-302504).

It was also proposed as alternative methods for achieving the inter-laminar insulation of wound magnetic cores that organometallic compounds such as metal alkoxides are coated to increase heat resistance temperatures of the insulating layers (Japanese Patent Laid-Open No. 63-110607), and that a mixture of a sol of partially hydrolyzed $SiO_2$-$TiO_2$ metal alkoxide and various ceramic powders is coated (Japanese Patent Laid-Open No. 63-302504).

However, in the case of the above fine crystalline, soft magnetic Fe-base alloys having extremely fine crystalline structures having an average grain size of 1000 Å or less (determined from maximum diameters of grains), their heat treatment temperatures are as high as 500° C. or even higher to cause crystallization, and the alloys become somewhat brittle after the heat treatment. Accordingly, the heat treatment should be conducted after the thin ribbons are coated with insulating layers. Therefore, insulating materials showing excellent heat resistance are needed.

However, in the case of insulating films, even though polyimide insulating films showing relatively high heat resistance are used as insulating materials, they are deteriorated at heat treatment temperatures of 500° C. or higher, failing to maintain sufficient insulation.

Alternatively, when ceramic powders such as $SiO_2$, MgO, $Al_2O_3$, etc. are used as insulating materials, since the ceramic particles are not completely bonded to the thin alloy ribbons, the insulating layers tend to be flowed away when the wound magnetic cores are immersed in a flowing cooling fluid.

In addition, since voltage of several tens of kV or more is applied to wound magnetic cores for transformers and saturable reactors for supplying high-voltage pulses as disclosed in Japanese Patent Laid-Open No. 63-229786, the conventional insulating layers inevitably suffer from increase in core losses due to insufficient insulation.

Insulating materials of metal alkoxides in which fine ceramic particles are dispersed are considered promising because of their heat resistance. However, in the case of the insulating layer made of a sol of partially hydrolyzed $SiO_2$-$TiO_2$ metal alkoxide and fine ceramic particles disclosed in Japanese Patent Laid-Open No. 63-302504, such metal alkoxide (partially hydrolyzed sol) shows heat shrinkage ratio (mainly due to cross-linking reaction), which is extremely different from the shrinkage ratio (due to fine crystallization) of the fine crystalline, soft magnetic Fe-base alloy. Accordingly, the resulting insulating layer has a large residual internal stress, which leads to the deterioration of magnetic properties of wound magnetic cores constituted by thin ribbons of the fine crystalline, soft magnetic Fe-base alloys.

OBJECT AND SUMMARY OF THE INVENTION

An object of the present invention is, accordingly, to provide a wound magnetic core constituted by a fine crystalline, soft magnetic Fe-base alloy having an extremely fine crystalline structure, which has a heat-resistant insulating layer whose insulation is not deteriorated by heat treatment for fine crystallization.

Another object of the present invention is to provide a method of producing such a wound magnetic core.

The wound magnetic core according to one embodiment of the present invention is constituted by (a) a thin ribbon made of a fine crystalline, soft magnetic Fe-base alloy having the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti and Mo, and a, x, y, z and $\alpha$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$ and $0.1 \leqq \alpha \leqq 30$, at least 50% of the alloy structure being occupied by fine crystal grains having an average grain size of 1000 Å or less; and (b) a heat-resistant insulating layer having a thickness of 0.5–5 μm formed on at least one surface of the thin ribbon, the heat-resistant insulating layer being made of a uniform mixture of 20–90 weight %, as $SiO_2$, of a silanol oligomer and 80–10 weight % of fine ceramic particles, which is subjected to a heat treatment to cross-link the silanol oligomer.

The wound magnetic core according to another embodiment of the present invention is constituted by (a) a thin ribbon made of a fine crystalline, soft magnetic Fe-base alloy having the composition represented by the general formula:

$$(Fe_{1-a}M_a)_{100-x-y-z-\alpha-\beta-\gamma}Cu_xSi_yB_z.M'_\alpha M''_\beta X_\gamma$$

wherein M is Co and/or Ni, M' is at least one element selected from the group consisting of Nb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$, $\beta \leqq 10$ and $\gamma \leqq 10$, at least 50% of the alloy structure being occupied by fine crystal grains having an average grain size of 1000 Å or less; and (b) a heat-resistant insulating layer having a thickness of 0.5–5 μm formed on at least one surface of the thin ribbon, the heat-resistant insulating layer being made of a uniform mixture of 20–90 weight %, as $SiO_2$, of a silanol oligomer and 80–10 weight % of fine ceramic particles, which is subjected to a heat treatment to cross-link the silanol oligomer.

The method of producing a wound magnetic core according to the present invention comprises the steps of:

(a) applying to at least one surface of a thin ribbon made of an amorphous alloy having the same composition as above a dispersion containing 20–90 weight %, as $SiO_2$, of a silanol oligomer and 80–10 weight % of fine ceramic particles based on a solid component, in a thickness of 0.5–5 μm on a dry basis:

(b) winding the thin ribbon after drying; and (c) subjecting the resulting wound magnetic core to a heat treatment at 450°–700° C. for 5 minutes–24 hours to finely crystallize the amorphous alloy and to cause the cross-linking of the silanol oligomer.

DETAILED DESCRIPTION OF THE INVENTION

Figure 1:
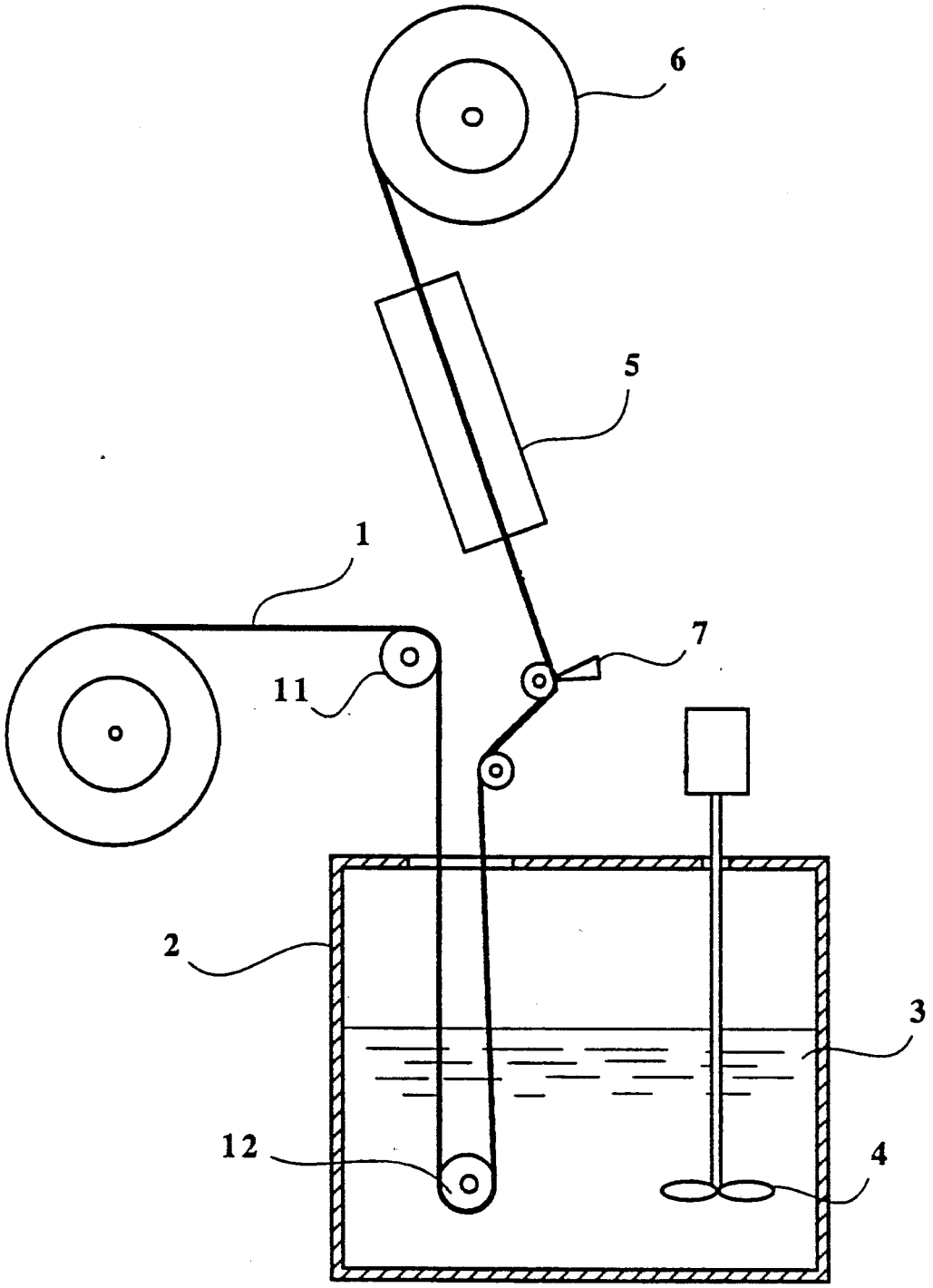
FIG. 1 is a schematic view showing an apparatus for producing the wound magnetic core according to the present invention.

In the fine crystalline, soft magnetic Fe-base alloy constituting the wound magnetic core of the present invention, Fe may be substituted by Co and/or Ni in the range of 0–0.5. However, to have good magnetic properties such as low core loss and magnetostriction, the content of Co and/or Ni which is represented by "a" is preferably 0–0.1. Particularly to provide a low-magnetostriction alloy, the range of "a" is preferably 0–0.05.

Cu is an indispensable element, and its content "x" is 0.1–3 atomic %. When it is less than 0.1 atomic %, substantially no effect on the reduction of core loss and on the increase in permeability can be obtained by the addition of Cu. On the other hand, when it exceeds 3 atomic %, the alloy's core loss becomes larger than those containing no Cu, reducing the permeability, too. The preferred content of Cu in the present invention is 0.5–2 atomic %, in which range the core loss is particularly small and the permeability is high.

The reasons why the core loss decreases and the permeability increases by the addition of Cu are not fully clear, but it may be presumed as follows:

Cu and Fe have a positive interaction parameter so that their solubility is low. However, since iron atoms or copper atoms tend to gather to form clusters, thereby producing compositional fluctuation. This produces a lot of domains likely to be crystallized to provide nuclei for generating fine crystal grains. These crystal grains are based on Fe, and since Cu is substantially not soluble in Fe, Cu is ejected from the fine crystal grains, whereby the Cu content in the vicinity of the crystal grains becomes high. This presumably suppresses the growth of crystal grains.

Because of the formation of a large number of nuclei and the suppression of the growth of crystal grains by the addition of Cu, the crystal grains are made fine, and this phenomenon is accelerated by the inclusion of Nb, Ta, W, Mo, Zr, Hf, Ti, etc.

Without Nb, Ta, W, Mo, Zr, Hf, Ti, etc., the crystal grains are not fully made fine and thus the soft magnetic properties of the resulting alloy are poor. Particularly Nb and Mo are effective, and particularly Nb acts to keep the crystal grains fine, thereby providing excellent soft magnetic properties. And since a fine crystalline phase based on Fe is formed, the Fe-base soft magnetic alloy of the present invention has smaller magnetostriction than Fe-base amorphous alloys, which means that the fine crystalline, soft magnetic Fe-base alloy of the present invention has smaller magnetic anisotropy due to internal stress-strain, resulting in improved soft magnetic properties.

Without the addition of Cu, the crystal grains are unlikely to be made fine. Instead, a compound phase is likely to be formed and crystallized, thereby deteriorating the magnetic properties.

Si and B are elements particularly for making fine the alloy structure. The fine crystalline, soft magnetic Fe-base alloy of the present invention is produced by once forming an amorphous alloy with the addition of Si and B, and then forming fine crystal grains by heat treatment.

The content of Si ("y") and that of B ("z") are $0 \leqq y \leqq 30$ atomic %, $0 \leqq z \leqq 25$ atomic %, and $5 \leqq y+z \leqq 30$ atomic %, because the alloy would have an extremely reduced saturation magnetic flux density if otherwise.

In the present invention, the preferred range of y is 6–25 atomic %, and the preferred range of z is 2–25 atomic %, and the preferred range of y+z is 14–30 atomic %. When y exceeds 25 atomic %, the resulting alloy has a relatively large magnetostriction under the condition of good soft magnetic properties, and when y is less than 6 atomic %, sufficient soft magnetic properties are not necessarily obtained. The reasons for limiting the content of B ("z") is that when z is less than 2 atomic %, uniform crystal grain structure cannot easily be obtained, somewhat deteriorating the soft magnetic properties, and when z exceeds 25 atomic %, the resulting alloy would have a relatively large magnetostriction under the heat treatment condition of providing good soft magnetic properties. With respect to the total amount of Si+B (y+z), when y+z is less than 14 atomic %, it is often difficult to make the alloy amorphous, providing relatively poor magnetic properties, and when y+z exceeds 30 atomic % an extreme decrease in a saturation magnetic flux density and the deterioration of soft magnetic properties and the increase in magnetostriction ensue. More preferably, the contents of Si and B are $10 \leqq y \leqq 25$, $3 \leqq z \leqq 18$ and $18 \leqq y+z \leqq 28$, and this range provides the alloy with excellent soft magnetic properties, particularly a saturation magnetostriction in the range of $-5\times10^{-6}$–$+5\times10^{6}$. Particularly preferred range is $11 \leqq y \leqq 24$, $3 \leqq z \leqq 9$ and $18 \leqq y+z \leqq 27$, and this range provides the alloy with a saturation magnetostriction in the range of $-1.5\times10^{-6}$–$+1.5\times10^{-6}$.

In the present invention, M' acts when added together with Cu to make the precipitated crystal grains fine. M' is at least one element selected from the group consisting of Nb, W, Zr, Hf, Ti and Mo. These elements have a function of elevating the crystallization temperature of the alloy, and synergistically with Cu having a function of forming clusters and thus lowering the crystallization temperature, they suppress the growth of the precipitated crystal grains, thereby making them fine.

The content of M' ($\alpha$) is 0.1–30 atomic %. When it is less than 0.1 atomic %, sufficient effect of making crystal grains fine cannot be obtained, and when it exceeds 30 atomic % an extreme decrease in saturation magnetic flux density ensues. The preferred content of M' is 0.1–10 atomic %, and more preferably $\alpha$ is 2–8 atomic %, in which range particularly excellent soft magnetic properties are obtained. Incidentally, most preferable as M' is Nb and/or Mo, and particularly Nb in terms of magnetic properties. The addition of M' provides the fine crystalline, soft magnetic Fe-base alloy with as high permeability as that of the Co-base, high-permeability materials.

M'', which is at least one element selected from the group consisting of V, Cr, Mn, Al, elements in the platinum group, Sc, Y, rare earth elements, Au, Zn, Sn and Re, may be added for the purposes of improving corrosion resistance or magnetic properties and of adjusting magnetostriction, but its content is at most 10 atomic %. When the content of M' exceeds 10 atomic %, an extreme decrease in a saturation magnetic flux density ensues. A particularly preferred amount of M' is 5 atomic % or less.

The fine crystalline, soft magnetic Fe-base alloy may contain 10 atomic % or less of at least one element X selected from the group consisting of C, Ge, P, Ga, Sb, In, Be, As. These elements are effective for making amorphous, and when added with Si and B, they help make the alloy amorphous and also are effective for adjusting the magnetostriction and Curie temperature of the alloy.

In sum, in the fine crystalline, soft magnetic Fe-base alloy having the general formula:

$$(Fe_{1-a}M_a)_{100-x-y-z-\alpha}Cu_xSi_yB_zM'_\alpha,$$

the general ranges of a, x, y, z and $\alpha$ are $0 \leqq a \leqq 0.5$ $0.1 \leqq x \leqq 3$ $0 \leqq y \leqq 30$ $0 \leqq z \leqq 25$ $5 \leqq y+z \leqq 30$ $0.1 \leqq \alpha \leqq 30,$ and the preferred ranges thereof are $0 \leqq a \leqq 0.1$ $0.1 \leqq x \leqq 3$ $6 \leqq y \leqq 25$ $2 \leqq z \leqq 25$ $14 \leqq y+z \leqq 30$ $0.1 \leqq \alpha \leqq 10,$ and the more preferable ranges are $0 \leqq a \leqq 0.1$ $0.5 \leqq x \leqq 2$ $10 \leqq y \leqq 25$ $3 \leqq z \leqq 18$ $18 \leqq y+z \leqq 28$ $2 \leqq \alpha \leqq 8,$ and the most preferable ranges are $0 \leqq a \leqq 0.05$ $0.5 \leqq x \leqq 2$ $11 \leqq y \leqq 24$ $3 \leqq z \leqq 9$ $18 \leqq y+z \leqq 27$ $2 \leqq \alpha \leqq 8.$ And in the fine crystalline, soft magnetic Fe-base alloy having the general formula:

$$(Fe_{1-a}M_a)_{100-x-y-z-\alpha-\beta-\gamma}Cu_xSi_yB_z.M'_\alpha M''_\beta X_\gamma,$$

the general ranges of a, x, y, z, $\alpha$, $\beta$ and $\gamma$ are $0 \leqq a \leqq 0.5$ $0.1 \leqq x \leqq 3$ $0 \leqq y \leqq 30$ $0 \leqq z \leqq 25$ $5 \leqq y+z \leqq 30$ $0.1 \leqq \alpha \leqq 30$ $\beta \leqq 10$ $\gamma \leqq 10,$ and the preferred ranges are $0 \leqq a \leqq 0.1$ $0.1 \leqq x \leqq 3$ $6 \leqq y \leqq 25$ $2 \leqq z \leqq 25$ $14 \leqq y+z \leqq 30$ $0.1 \leqq \alpha \leqq 10$ $\beta \leqq 5$ $\gamma \leqq 5,$ and the more preferable ranges are $0 \leqq a \leqq 0.1$ $0.5 \leqq x \leqq 2$ $10 \leqq y \leqq 25$ $3 \leqq z \leqq 18$ $18 \leqq y+z \leqq 28$ $2 \leqq \alpha \leqq 8$ $\beta \leqq 5$ $\gamma \leqq 5,$ and the most preferable ranges are $0 \leqq a \leqq 0.05$ $0.5 \leqq x \leqq 2$ $11 \leqq y \leqq 24$ $3 \leqq z \leqq 9$ $18 \leqq y+z \leqq 27$ $2 \leqq \alpha \leqq 8$ $\beta \leqq 5$ $\gamma \leqq 5.$ The fine crystalline, soft magnetic Fe-base alloy having the above composition has an alloy structure, at least 50% of which consists of fine crystal grains. These crystal grains are based on $\alpha$-Fe having a bcc structure, in which Si, B, etc. are dissolved. These crystal grains have an extremely small average grain size of 1000 Å or less, and are uniformly distributed in the alloy structure. Incidentally, the average grain size of the crystal grains is determined by measuring the maximum size of each grain and averaging them. When the average grain size exceeds 1000 Å, good soft magnetic properties are not obtained. It is preferably 500 Å or less, more preferably 200 Å or less and particularly 50-200 Å. The remaining portion of the alloy structure other than the fine crystal grains is mainly amorphous. Even with fine crystal grains occupying substantially 100% of the alloy structure, the fine crystalline, soft magnetic Fe-base alloy of the present invention has sufficiently good magnetic properties.

Incidentally, with respect to inevitable impurities such as N, O, S, etc., it is to be noted that the inclusion thereof in such amounts as not to deteriorate the desired properties is not regarded as changing the alloy composition of the present invention suitable for magnetic cores, etc.

Next, the method of producing the fine crystalline, soft magnetic Fe-base alloy will be explained in detail below.

First, a melt of the above composition is rapidly quenched by known liquid quenching methods such as a single roll method, a double roll method, etc. to form amorphous alloy ribbons. Usually amorphous alloy ribbons produced by the single roll method, etc. have a thickness of 5-100 μm or so, and those having a thickness of 25 μm or less are particularly suitable as magnetic core materials for use at high frequency.

These amorphous alloys may contain crystal phases, but the alloy structure is preferably amorphous to make sure the formation of uniform fine crystal grains by a subsequent heat treatment. Incidentally, the alloy of the present invention can be produced directly by the liquid quenching method without resorting to heat treatment, as long as proper conditions are selected.

The amorphous ribbons are wound before heat treatment, for the reasons that the ribbons have good workability in an amorphous state, but that once crystallized they lose workability.

The heat treatment is carried out by heating the amorphous alloy ribbon wound in a desired shape in vacuum or in an inert gas atmosphere such as hydrogen, nitrogen, argon, etc. The temperature and time of the heat treatment may vary depending upon the composition of the amorphous alloy ribbon and the shape and size of a magnetic core made from the amorphous alloy ribbon, etc., but in general it is preferably 450°-700° C. for 5 minutes to 24 hours. When the heat treatment temperature is lower than 450° C., crystallization is unlikely to take place with ease, requiring too much time for the heat treatment. On the other hand, when it exceeds 700° C., coarse crystal grains tend to be formed, making it difficult to obtain fine crystal grains. And with respect to the heat treatment time, when it is shorter than 5 minutes, it is difficult to heat the overall worked alloy at a uniform temperature, providing uneven magnetic properties, and when it is longer than 24 hours, productivity becomes too low and also the crystal grains grow excessively, resulting in the deterioration of magnetic properties. The preferred heat treatment conditions are, taking into consideration practicality and uniform temperature control, etc., 500°-650° C. for 5 minutes to 6 hours.

The heat treatment atmosphere is preferably an inert gas atmosphere, but it may be an oxidizing atmosphere such as the air. Cooling may be carried out properly in the air or in a furnace. And the heat treatment may be conducted by a plurality of steps.

The heat treatment can be carried out in a magnetic field to provide the alloy with magnetic anisotropy. When a magnetic field is applied in parallel to the magnetic path of a magnetic core made of the alloy of the present invention in the heat treatment step, the resulting heat-treated magnetic core has a good squareness in a B-H curve thereof, so that it is particularly suitable for saturable reactors, magnetic switches, pulse compression cores, reactors for preventing spike voltage, etc. On the other hand, when the heat treatment is conducted while applying a magnetic field in perpendicular to the magnetic path of a magnetic core, the B-H curve inclines, providing it with a small squareness ratio and a constant permeability. Thus, it has a wider operational range and thus is suitable for transformers, noise filters, choke coils, etc.

The magnetic field need not be applied always during the heat treatment, and it is necessary only when the alloy is at a temperature lower than the Curie temperature Tc thereof. In the present invention, the alloy has an elevated Curie temperature because of crystallization than the amorphous counterpart, and so the heat treatment in a magnetic field can be carried out at temperatures higher than the Curie temperature of the corresponding amorphous alloy. In the case of the heat treatment in a magnetic field, it may be carried out by two or more steps. Also, a rotational magnetic field can be applied during the heat treatment.

Next, the heat-resistant insulating layer of the present invention is made of 20–90 weight %, as $SiO_2$, of a silanol oligomer and 80–10 weight % of fine ceramic particles.

The silanol oligomer is a polymerized product of a silanol which is a hydrolyzate, or a hydrolyzed product, of a silicon alkoxide substantially having the structure represented by the formula of $RSi(OR)_3$. The hydrolysis reaction of silicon alkoxide takes place as follows:

$$-\overset{|}{\underset{|}{Si}}-OR + H_2O \longrightarrow -\overset{|}{\underset{|}{Si}}-OH + ROH \quad (1)$$

Since the silanol shows a high reactivity, it is easily polymerized. The average molecular weight of the silanol oligomer may be determined depending upon the desired viscosity of a coating liquid, and the shrinkage ratio of the coating layer. When the average molecular weight is too large, the coating liquid shows too high a viscosity, and when it is too small, the resulting insulating layer shows too much shrinkage ratio due to cross-linking. Accordingly, the average molecular weight of the silanol oligomer is preferably about 500–8000, particularly about 2000.

The silicon alkoxide forming the silanol oligomer by hydrolysis substantially has the following structure:

$$RSi(OR)_3,$$

wherein R represents a phenyl group or an alkyl group. From the aspect of film-forming properties and temperature and time in the formation of insulating layers, lower alkyl groups such as an ethyl group and a methyl group are more preferable than the phenyl group.

When the silicon alkoxide contains two alkoxyl groups in one molecule, the polymerized product is a silicon oil. And when it contains four alkoxyl groups, too much cross-linking takes place, resulting in increase in shrinkage ratio. However, when it contains three alkoxyl groups, the cross-linking is partially prevented by R groups, resulting in the desired cross-linking degree as a whole. Therefore, the silicon alkoxide should have substantially three alkoxyl groups.

The cross-linking reaction of the silanol oligomer make take place by a dehydration reaction or dealcohol reaction shown by the following equations:

$$\begin{array}{l} HO-Si-O- \ldots Si-OH + HO-Si-O \ldots \\ \quad Si-OH \rightarrow HO-Si-O- \ldots Si-OH + H_2O \end{array} \quad (2)$$

$$\begin{array}{l} HO-Si-O- \ldots Si-OH + RO-Si-O \ldots \\ \quad Si-OH \rightarrow HO-Si-O- \ldots Si-OH + ROH \end{array} \quad (3)$$

The cross-linking products thus obtained have the following cross-linking structure:

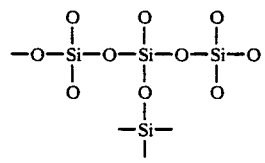

(4)

Incidentally, although there are various metal alkoxides other than silicon alkoxide, they should show similar shrinkage ratio by cross-linking to that of the fine crystalline, soft magnetic Fe-base alloy. In this respect, the silicon alkoxide should be used. Specifically speaking, when the fine crystalline, soft magnetic Fe-base alloy is heated at 450°–700° C. for fine crystallization, it shows an extreme shrinkage ratio. Accordingly, if the heat-resistant insulating layer does not show a similar shrinkage ratio, internal stress would remain in the heat-resistant insulating layer, causing strain therein, since this deteriorates the magnetic properties of the wound magnetic core, an insulating material showing a shrinkage ratio similar to that of the fine crystalline, soft magnetic Fe-base alloy should be used to prevent strain from being generated by heat shrinkage in the resulting insulating layer.

The fine ceramic particles contained in the heat-resistant insulating layer include fine particles of $SiO_2$, MgO, $Al_2O_3$, SiC, BN, $Si_3N_4$, $TiO_2$, etc. The fine ceramic particles preferably have a particle size of 0.1 μm or less, and they are preferably colloidal particles. From the aspect to the affinity to the silicon alkoxide, colloidal silica is particularly preferable.

By cross-linking a coating layer comprising the above insulating fine ceramic particles dispersed in the silanol oligomer, it is possible to prevent the heat-resistant insulating layer from being flowed away from between the ribbon layers constituting the wound magnetic core, and to achieve a desired thickness of the insulating layer.

In the heat-resistant insulating layer, the content of the silanol oligomer (on a dry basis) is 20–90 weight % as $SiO_2$, and the content of the fine ceramic particles is 80–10 weight %. When the content of the silanol oligomer is lower than 20 weight % (the content of the fine ceramic particles exceeds 80 weight %), the insulating layer shows insufficient strength, providing insufficient stress-absorbing function by the fine ceramic particles. On the other hand, when the content of the silanol oligomer exceeds 90 weight % (the content of the fine ceramic particles is lower than 10 weight %), the insulating layer does not have a sufficient thickness. The preferred content of the silanol oligomer is 40–60 weight % (the preferred content of the fine ceramic particles is 60–40 weight %). Incidentally, when the insulating layer shows poor bonding strength to the thin alloy ribbon, cracking tends to appear in the insulating layer. Therefore, the content of the silanol oligomer is preferably adjusted to a proper level.

The insulating layer consisting of the silanol oligomer and the fine ceramic particles is applied in the form of a dispersion and dried. Organic solvents for dissolving the silanol oligomer and the fine ceramic particles include, from the aspect of producing the wound magnetic core, preferably alcohols having such low-boiling points that do not make the coating operation difficult. The preferred organic solvents are easily dryable solvents such as propyl alcohol, ethyl alcohol, methyl alcohol, isopropyl alcohol, etc.

In the selection of these organic solvents, easiness of coating and a pot life in which the dispersion can be used, etc. should be taken into consideration.

The solid component consisting of the silanol oligomer and the fine ceramic particles is 2–50 weight % in the dispersion. When the solid component is lower than 2 weight %, it is difficult to produce an insulating layer having a thickness of 0.5 μm or more. On the other hand, when it exceeds 50 weight %, the coating liquid should too much viscosity and so poor fluidity, making coating operation difficult.

Because an appropriate insulation breakdown voltage is required (the breakdown voltage should generally be several V to several hundred V), the thickness of the insulating layer should 0.5–5 μm. For this purpose, the solid component in the dispersion is particularly 20–30 weight %.

The insulating layer can be formed by applying or spraying the dispersion to the thin alloy ribbon or immersing the thin alloy ribbon in the dispersion. To improve the wettability of the thin alloy ribbon by dispersion, it is effective to add small amounts of acids or bases such as $H_2SO_4$, $NH_3$, etc. to the dispersion to adjust its pH. In this case, the pH should be controlled in the range of 5.5–10 or so.

After applying the dispersion, the thin ribbon is sufficiently dried and wound. This can be conducted by using the apparatus shown in FIG. 1. The thin ribbon of an amorphous alloy 1 is introduced into a bath 2 via a guide roll 11 and turns around a guide roll 12 immersed in a dispersion 3, so that it is coated with a dispersion on both surfaces. After removing an excess dispersion by a scraper 7, the thin ribbon passes through a hot-air dryer 5 and the dried thin ribbon is wound to form a wound magnetic core 6. Incidentally, the dispersion 3 is always stirred by a stirrer 4.

The wound magnetic core thus formed with an insulating layer is then subjected to a heat treatment under the above conditions for fine crystallization. By this heat treatment, the silanol oligomer undergoes a cross-linking reaction to have a cross-linked structure shown by the formula (4).

The insulating layer is strengthened by the cross-linking reaction. As a result, even though a cooling fluid flows over the wound magnetic core, the insulating layer is unlikely to be lossed.

By using a silicon alkoxide substantially having the structure of $RSi(OR)_3$ as a starting material of the silanol oligomer, and by forming the coating layer consisting of the silanol oligomer and the fine ceramic particles on the thin ribbon of an amorphous alloy and then subjecting it to a heat treatment at a fine crystallization temperature of 450°–700° C., the resulting coating layer is hardened by cross-linking and shows a similar shrinkage ratio to that of the fine crystalline, soft magnetic Fe-base alloy. The reasons therefor are considered as follows:

(1) Since excess cross-linking reaction does not take place due to the existence of the R groups, the insulating layers' shrinkage ratio can be controlled.
(2) Stress caused by the shrinkage of the coating layer can be absorbed by the fine ceramic particles.

The present invention will be explained in detail by the following Examples, without intention of restricting the scope of the present invention.

EXAMPLE 1

A thin ribbon of an amorphous alloy having a thickness of 18 μm and a width of 25 mm was produced by a single roll method from an alloy melt of Cu 1%, Nb 3%, Si 13%, B 7%, Fe balance (atomic %). This thin amorphous alloy ribbon was cut to a length of 100 mm, and coated with various insulating coating liquids having the following compositions. After drying, each sample was heated to 550° C. at 5° C./min, kept at 550° C. for 1 hour and then left to stand. Each thin ribbon was measured with respect to the change of its longitudinal length. The results are shown in Table 1. Incidentally, each insulating layer had a thickness of 4 μm.

TABLE 1

| Sample No. | Oligomers Type | Oligomers Weight % | Fine Ceramic Particles Type | Fine Ceramic Particles Weight % | Warp of Thin Ribbon |
|---|---|---|---|---|---|
| 1 | Methyltrimethoxy Silane | 10(3) | Colloidal Silica | 10 | 5 mm or less |
| 2 | Tetratrimethoxy Silane | 10(3) | Colloidal Silica | 10 | x(4) |
| 3 | Oligomer of $SiZrO_4$ Alkoxide(1) | — | — | — | 10–15 mm |
| 4 | Oligomer of $SiO_2$—$TiO_2$ Alkoxide(2) | — | — | — | 5 mm(5) or less |

Note
(1)G-401 manufactured by Nichiita Kenkyujo.
(2)G-1100 manufactured by Nichiita Kenkyujo.
(3)Expressed as $SiO_2$ content.
(4)Thin ribbon rounded.
(5)There were cracks on the coating surface.

EXAMPLES 2–6, COMPARATIVE EXAMPLES 1 AND 2

Thin ribbons of amorphous alloys of Cu 1%, Nb 2.2%, Si 12.7%, B 10% and balance substantially Fe (atomic %) were coated with dispersions having various compositions. The dispersions contained 4–20 weight %, as $SiO_2$, of oligomers of the hydrolyzed products of methyltrimethoxy silane ($CH_3Si(OCH_3)_3$) having a molecular weight of 2000, 7 weight %, based on the silanol oligomer (as $SiO_2$), of colloidal silica (average particle size: 20–30 milli-μm), and a remaining amount of isopropyl alcohol. A small amount of $NH_3$ was added to the dispersions to have a pH of 8.5. Wound magnetic cores were produced by using various dispersions in the apparatus shown in FIG. 1. Each wound magnetic core was heated to 530° C. and kept at that temperature for 120 minutes to finely crystallize the alloy. The properties of the resulting wound magnetic cores are shown in Table 2. For comparison, Table 2 contains Comparative Example 1 showing a case where there is no insulating layer, and Comparative Example 2 showing a case where the silanol oligomer is 0.2 weight %.

TABLE 2

| | Example No. | | | | | Comparative Example No. | |
|---|---|---|---|---|---|---|---|
| | 2 | 3 | 4 | 5 | 6 | 1 | 2 |
| Silanol Oligomer (wt. %) | 4 | 8 | 12 | 16 | 20 | — | 0.2 |
| Colloidal Silica (wt. % (1)) | 7 | 7 | 7 | 7 | 7 | — | 7 |
| Average Thickness of Insulating Layer (μm) | 1.2 | 2.3 | 2.9 | 3.0 | 3.7 | — | <0.1 |
| Breakdown Voltage (V) | >100 | >200 | >250 | >400 | >500 | — | >15 |
| Space Factor (%) | 75 | 68 | 65 | 62 | 50 | 81 | 79 |
| DC Magnetic Properties | | | | | | | |
| $B_{80}$ (T) | 1.31 | 1.31 | 1.30 | 1.29 | 1.28 | 1.32 | 1.32 |
| $Br/B_{800}$ (%) | 59 | 53 | 47 | 48 | 48 | 57 | 55 |
| Hc (A/m) | 1.1 | 1.3 | 1.2 | 1.2 | 1.8 | 0.8 | 0.9 |
| AC Magnetic Properties | | | | | | | |
| $W_{0.2/20kHz}$ (kW/m$^3$) | 35 | 38 | 42 | 48 | 50 | 82 | 40 |
| $W_{0.2/100kHz}$ (kW/m$^3$) | 400 | 480 | 520 | 570 | 610 | 900 | 450 |
| $\mu e_{10kHz}$ | 52,000 | 46,000 | 44,000 | 41,000 | 39,000 | 18,000 | 34,000 |
| $\mu e_{100kHz}$ | 12,000 | 12,000 | 10,000 | 9,000 | 7,900 | 8,000 | 12,000 |

Note
(1): Based on silanol oligomer.

$B_{80}$ denotes a magnetic flux density when an exciting magnetic field is 80 A/m, $Br/B_{800}$ denotes a ratio of a residual magnetic flux density Br to a magnetic flux density $B_{800}$ at an exciting magnetic field of 800 A/m, $W_{0.2/20kHz}$ denotes a core loss (unit: kW/m$^3$) at a frequency of 20 kHz and a magnetic flux of 0.2 T, and $W_{0.2/100kHz}$ denotes a core loss at a frequency of 100 kHz and a magnetic flux of 0.2 T.

As is clear from Table 2, with respect to DC magnetic properties, particularly coercive force, those having no insulating layers are better. However, with respect to AC properties, particularly permeability and core loss, the wound magnetic cores of the present invention are much better than those having no insulating layers.

EXAMPLES 7-9, COMPARATIVE EXAMPLE 3

Thin ribbons of amorphous alloys of Cu 0.5%, Nb 3%, Si 12%, B 9% and balance substantially Fe (atomic %) were coated with dispersions having various compositions. The dispersions contained 2-10 weight %, as $SiO_2$, of an oligomer produced from a 1:9 (by weight) mixture of methyltriethoxy silane and phenylethoxy silane, 2 weight % of MgO particles having an average particle size of 0.3 μm (20-100% of the amount of the silanol oligomer), 2-10 weight % of propyl alcohol (the same amount as that of the silanol oligomer) and a remaining amount of methyl alcohol. The same heat treatment as in Examples 2-6 was conducted to produce wound magnetic cores. Each wound magnetic core was heat-treated at 550° C. for 90 minutes while applying a magnetic field of 640 A/m along the longitudinal direction of the magnetic path, and then slowly cooled to 150° C. at a rate of 100° C./hr. This is a heat treatment condition for obtaining a high-squareness ratio material. The properties of the resulting wound magnetic cores are shown in Table 3 together with those of Comparative Example 3.

TABLE 3

| | Example No. | | | Comparative Example No. |
|---|---|---|---|---|
| | 7 | 8 | 9 | 3 |
| Silanol Oligomer (wt. %[1]) | 2 | 5 | 10 | 0 |

TABLE 3-continued

| | Example No. | | | Comparative Example No. |
|---|---|---|---|---|
| | 7 | 8 | 9 | 3 |
| Fine MgO Particles (wt. %) | 2 | 2 | 2 | 0 |
| Average Thickness of Insulating Layer (μm) | 2.1 | 3.8 | 5.0 | 0 |
| Breakdown Voltage (V) | >170 | >350 | >400 | — |
| Space Factor (%) | 77 | 73 | 66 | 79 |
| DC Magnetic Properties | | | | |
| $B_{80}$ (T) | 1.16 | 1.10 | 1.13 | 1.20 |
| $Br/B_{800}$ (%) | 86 | 81 | 84 | 89 |
| Hc (A/m) | 0.95 | 1.3 | 1.1 | 0.90 |
| AC Magnetic Properties | | | | |
| $W_{0.2/100kHz}$ (kW/m$^3$) | 760 | 820 | 840 | 970 |

Note
[1]As $SiO_2$.

EXAMPLES 10 AND 11

Using the same thin ribbons and layer-forming materials as in Example 9 and changing the MgO powder to $Al_2O_3$ powder having an average particle size of 0.8 μm and BN powder having an average particle size of 0.3 μm, the same treatment as in Example 1 was conducted. The results are shown in Table 4.

In these cases, the high-frequency magnetic properties are extremely improved as in Example 9 using MgO, as compared with those having no insulating layers.

TABLE 4

| | Example No. | | Comparative Example No. |
|---|---|---|---|
| | 10 | 11 | 3 |
| Fine Ceramic Particles | $Al_2O_3$ | BN | None |
| Average Thickness of Insulating Layer (μm) | 4.7 | 3.4 | — |
| Breakdown Voltage (V) | >400 | >400 | — |
| Space Factor (%) | 72 | 74 | 79 |
| DC Magnetic Properties | | | |
| $B_{80}$ (T) | 1.15 | 1.18 | 1.20 |
| $Br/B_{800}$ (%) | 85 | 87 | 89 |

TABLE 4-continued

| | Example No. | | Comparative Example No. |
|---|---|---|---|
| | 10 | 11 | 3 |
| Hc (A/m) | 1.2 | 1.1 | 0.90 |
| AC Magnetic Properties | | | |
| $W_{0.2/100kHz}$ (kW/m$^3$) | 660 | 710 | 970 |

Since the heat-resistant insulating layer of the present invention serves to increase high-frequency magnetic properties due to increase in inter-laminar insulation, the wound magnetic cores show the breakdown voltage of several tens of volts or more. These wound magnetic cores are suitable for use in applications in which operation is conducted by high-voltage pulses.

What is claimed is:

1. A wound magnetic core constituted by (a) thin ribbon made of fine crystalline, soft magnetic Fe-base alloy having the composition represented by the general formula:

$$(Fe_{1-a}M_a)_{100-x-y-z-\alpha}Cu_xSi_yB_zM'_\alpha$$

wherein M is Co and/or Ni, M' is at least one element selected from the group consisting of Nb, W, Ta, Zr, Hf, Ti and Mo, and a, x, y, z and $\alpha$ respectively satisfy $0 \leqq a \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$, at least 50% of the alloy structure being occupied by fine crystal grains having an average grain size of 1000 Å or less; and (b) a heat-resistant insulating layer having a thickness of 0.5–5 $\mu$m formed on at least one surface of said thin ribbon, said heat-resistant insulating layer being made of a uniform mixture of 20–90 weight %, as $SiO_2$, of a silanol oligomer and 80–10 weight % of fine ceramic particles, in which said thin ribbon having said heat-resistant insulating layer formed on at least one surface of said thin ribbon has been wound and then has been subjected to a heat treatment to cross-link said silanol oligomer.

2. The wound magnetic core according to claim 1, wherein said silanol oligomer is a polymer of a hydrolyzate of a silicon alkoxide substantially having the structure represented by $RSi(OR)_3$, said silanol oligomer having an average molecular weight of 500–8000.

3. The wound magnetic core according to claim 1, wherein said fine ceramic particles are ceramic colloidal particles.

4. The wound magnetic core according to claim 3, wherein said ceramic colloidal particles are colloidal silica.

5. A wound magnetic core constituted by (a) thin ribbon made of fine crystalline, soft magnetic Fe-base alloy having the composition represented by the general formula:

$$(Fe_{1-a}M_a)_{100-x-y-z-\alpha-\beta-\gamma}Cu_xSi_yB_z.M'_\alpha M''_\beta X_\gamma$$

wherein M is Co and/or Ni, M' is at least one element selected from the group consisting of Mb, W, Ta, Zr, Hf, Ti and Mo, M'' is at least one element selected from the group consisting of V, Cr, Mn, Al, elements in the platinum group, Sc, Y, rare earth elements, Au, Zn, Sn and Re, X is at least one element selected from the group consisting of C, Ge, P, Ga, Sb, In, Be and As, and a, x, y, z, $\alpha$, $\beta$ and $\gamma$ respectively satisfy $0 \leqq \alpha \leqq 0.5$, $0.1 \leqq x \leqq 3$, $0 \leqq y \leqq 30$, $0 \leqq z \leqq 25$, $5 \leqq y+z \leqq 30$, $0.1 \leqq \alpha \leqq 30$, $\beta \leqq 10$ and $\gamma \leqq 10$, at least 50% of the alloy structure being occupied by fine crystal grains having an average grain size of 1000 Å or less; and (b) a heat-resistant insulating layer having a thickness of 0.5–5 $\mu$m formed on at least one surface of said thin ribbon, said heat-resistant insulating layer being made of a uniform mixture of 20–90 weight &, as $SiO_2$, of a silanol oligomer and 80–10 weight % of fine ceramic particles, in which said thin ribbon having said heat-resistant insulating layer formed on at least one surface of said thin ribbon has been wound and then has been subjected to a heat treatment to cross-link said silanol oligomer.

6. The wound magnetic core according to claim 5, wherein said silanol oligomer is a polymer of a hydrolyzate of a silicon alkoxide substantially having the structure represented by $RSi(OR)_3$, said silanol oligomer having an average molecular weight of 500–8000.

7. The wound magnetic core according to claim 5, wherein said fine ceramic particles are ceramic colloidal particles.

8. The wound magnetic core according to claim 7, wherein said ceramic colloidal particles are colloidal silica.

* * * * *

UNITED STATES PATENT AND TRADEMARK OFFICE

CERTIFICATE OF CORRECTION

PATENT NO. : 5,072,205

DATED : December 10, 1991

INVENTOR(S) : Shunsuke Arakawa, Kiyotaka Yamauchi and Noriyoshi Hirao

It is certified that error appears in the above-identified patent and that said Letters Patent is hereby corrected as shown below:

Claim 5, column 16, line 15, "Mb" should read --Nb--; and line 30, "&" (ampersand) should read --%-- (percent).

Signed and Sealed this

First Day of June, 1993

*Attest:*

Michael K. Kirk

MICHAEL K. KIRK

*Attesting Officer*

*Acting Commissioner of Patents and Trademarks*